US008745763B2

(12) United States Patent
Cho

(10) Patent No.: US 8,745,763 B2
(45) Date of Patent: Jun. 10, 2014

(54) HELMET

(75) Inventor: Bom Shik Cho, Yongin-si (KR)

(73) Assignee: HJC Corp., Yongin-Si (KR)

( * ) Notice: Subject to any disclaimer, the term of this patent is extended or adjusted under 35 U.S.C. 154(b) by 202 days.

(21) Appl. No.: 13/387,388

(22) PCT Filed: Jun. 10, 2010

(86) PCT No.: PCT/KR2010/003725

§ 371 (c)(1),
(2), (4) Date: Jan. 27, 2012

(87) PCT Pub. No.: WO2011/013902

PCT Pub. Date: Feb. 3, 2011

(65) Prior Publication Data

US 2012/0117718 A1 May 17, 2012

(30) Foreign Application Priority Data

Jul. 29, 2009 (KR) ..... 10-2009-0069582

(51) Int. Cl.
*A61F 9/00* (2006.01)

(52) U.S. Cl.
USPC ..... 2/15; 2/424

(58) Field of Classification Search
USPC ..... 2/422, 424, 425, 9, 15
See application file for complete search history.

(56) References Cited

U.S. PATENT DOCUMENTS

| | | | | |
|---|---|---|---|---|
| 4,581,775 | A * | 4/1986 | Nava | 2/424 |
| 4,860,389 | A * | 8/1989 | Morin | 2/424 |
| 5,048,129 | A * | 9/1991 | Kamata | 2/424 |
| 5,084,918 | A * | 2/1992 | Breining et al. | 2/424 |
| 5,553,329 | A * | 9/1996 | Casartelli | 2/424 |
| 6,212,689 | B1 * | 4/2001 | Lee | 2/424 |
| 6,598,238 | B2 * | 7/2003 | Hong et al. | 2/424 |
| 6,892,400 | B1 * | 5/2005 | Choi et al. | 2/424 |
| 7,024,704 | B2 * | 4/2006 | Gafforio et al. | 2/424 |
| 7,093,302 | B1 * | 8/2006 | Burns | 2/8.1 |
| 7,181,777 | B2 * | 2/2007 | Choi et al. | 2/424 |
| 8,375,474 | B2 * | 2/2013 | Arai | 2/424 |
| 2003/0051289 | A1 * | 3/2003 | Gafforio et al. | 2/424 |
| 2005/0015861 | A1 * | 1/2005 | Gafforio et al. | 2/424 |
| 2007/0136933 | A1 * | 6/2007 | Kim et al. | 2/424 |

* cited by examiner

*Primary Examiner* — Khoa Huynh
*Assistant Examiner* — Andrew W Collins
(74) *Attorney, Agent, or Firm* — Pearne & Gordon LLP

(57) ABSTRACT

There is provided a helmet including a shield having inner coupling holes at both ends thereof and fitted and coupled to an assembly coupling hole of a shield coupling assembly provided at a helmet main body and a front opening configured to be opened and closed by the shield. The helmet includes: a lock supporting member fixed to the helmet main body; and a locker including a shield mounting portion fixed to the shield, a coupling shaft coupled to be rotated with the shield mounting portion at an end of the locker, and a locker hooking part coupled to or decoupled from the lock supporting member at the other end of the locker.

8 Claims, 10 Drawing Sheets

HELMET

TECHNICAL FIELD

The present disclosure relates to a helmet in which a front opening provided at a front side of the helmet has a retractable shield, and more specifically, to a one-touch open helmet in which a shield can be opened and a position of the shield can be adjusted by one-touch operation.

BACKGROUND ART

A rider is necessarily required to wear a helmet when riding a two-wheeled vehicle such as a motorcycle, and the helmet generally has a front opening at a front side of its main body in order to allow a wearer to obtain a front view. Further, the helmet generally has a selectively retractable shield to prevent wind or dust from being introduced through the front opening while the motorcycle moves forwards.

For this reason, the helmet includes a certain coupling unit for coupling the shield to the helmet main body. To be more specific, the coupling unit includes shield coupling assemblies provided at both sides of the helmet main body and assembly coupling parts provided at both inner ends of the shield so as to be fitted and coupled to the shield coupling assemblies.

A helmet has a hermetically sealed structure where little air can get in or get out, which makes a helmet wearer easily feel it is stuffy inside the helmet or which makes the inside of a shield damp with humidity, thereby blocking the helmet wearer's view. In order to solve these problems, conventionally, a shield which may block a wearer's view is opened or air outside a helmet is introduced into the helmet through a separate ventilation opening. Further, there has been known a helmet which, if it is provided with an openable shield, includes a separate shield locking device for preventing unintended opening of the shield.

DISCLOSURE OF THE INVENTION

Problems to Be Solved by the Invention

The present disclosure provides an improved helmet in which when a shield is lowered, it is automatically closed so as to prevent unintended opening of the shield and when the shield is opened by one-touch operation, air outside the helmet is introduced into the helmet but wind flowing into the helmet through a front opening does not block a helmet wearer's view.

Means for Solving the Problems

In accordance with a first aspect of the present disclosure, there is provided a helmet including a shield having inner coupling holes at both ends thereof and fitted and coupled to an assembly coupling hole of a shield coupling assembly provided at a helmet main body and a front opening configured to be opened and closed by the shield. The helmet includes: a lock supporting member fixed to the helmet main body; and a locker including a shield mounting portion fixed to the shield, a coupling shaft coupled to be rotated with the shield mounting portion at an end of the locker, and a locker hooking part coupled to or decoupled from the lock supporting member at the other end of the locker.

In the helmet, the locker further includes a touch unit having a handle protruded outwards from the shield and the locker further includes an elastic member configured to supply predetermined elasticity to keep the locker hooking part fitted and coupled to the lock supporting member coupled thereto if the locker hooking part is coupled to the lock supporting member.

Further, the shield includes shield elasticity supplying parts protruded at both inner sides thereof, and the shield coupling assembly elastically supports the shield elasticity supplying parts in a direction to an opened position of the shield when the shield is at a closed position.

Further, the shield coupling assembly includes: a supporting plate attached to both sides of the helmet main body; a rotation guiding unit attached to and supported by the supporting plate to be fitted and coupled to the inner coupling holes of the shield 110 and capable of supporting the shield to be rotated up and down without being separated from the helmet main body; and an elastic unit capable of supplying predetermined elasticity to the shield elasticity supplying parts in the direction to the opened position of the shield when the shield is at the closed position and the elastic unit includes: an elasticity applying body elastically coupled to the supporting plate; and an elastic body provided between the elasticity applying body and the supporting plate, wherein when the shield at the closed position is opened, the elastic body applies the predetermined elasticity to the shield elasticity supplying parts in the direction to the opened position of the shield to partially open the shield.

In accordance with a second aspect of the present disclosure, there is provided a helmet including a shield having inner coupling holes at both ends thereof and fitted and coupled to an assembly coupling hole of a shield coupling assembly provided at a helmet main body and a front opening configured to be opened and closed by the shield. The helmet includes a lock supporting member fixed to the helmet main body; and a locker fixed to the shield to be coupled to or decoupled from the lock supporting member, wherein when the shield is at a closed position, the locker is coupled to the lock supporting member and when the shield is at an opened position, the locker is decoupled from the lock supporting member, and when the shield moves from the opened position to the closed position, the locker is hooked by the lock supporting member and automatically coupled thereto.

In the helmet, when the shield is at the closed position, the shield is elastically supported by the shield coupling assembly to have predetermined elasticity in a direction to the opened position thereof and when the shield at the closed position is opened, the elastically supported shield is partially opened in the direction to the opened position.

Effect of the Invention

In accordance with one of the above-described means for solving the problems, a locker fixed to a shield enables a helmet wearer to readily lock the shield just by lowering the shield.

Further, the shield is opened so as not to block the helmet wearer's view and air outside the helmet can be introduced into the helmet. Thus, the helmet wearer can open the shield while moving. It is not necessary to provide an additional ventilation opening, and, thus, a helmet structure can be simplified.

Furthermore, since the shield is fitted and coupled to a shield coupling assembly, an opening degree of the shield can be adjusted step by step and an adjusted position of the shield can be maintained.

BEST MODE FOR CARRYING OUT THE INVENTION

Figure 1:
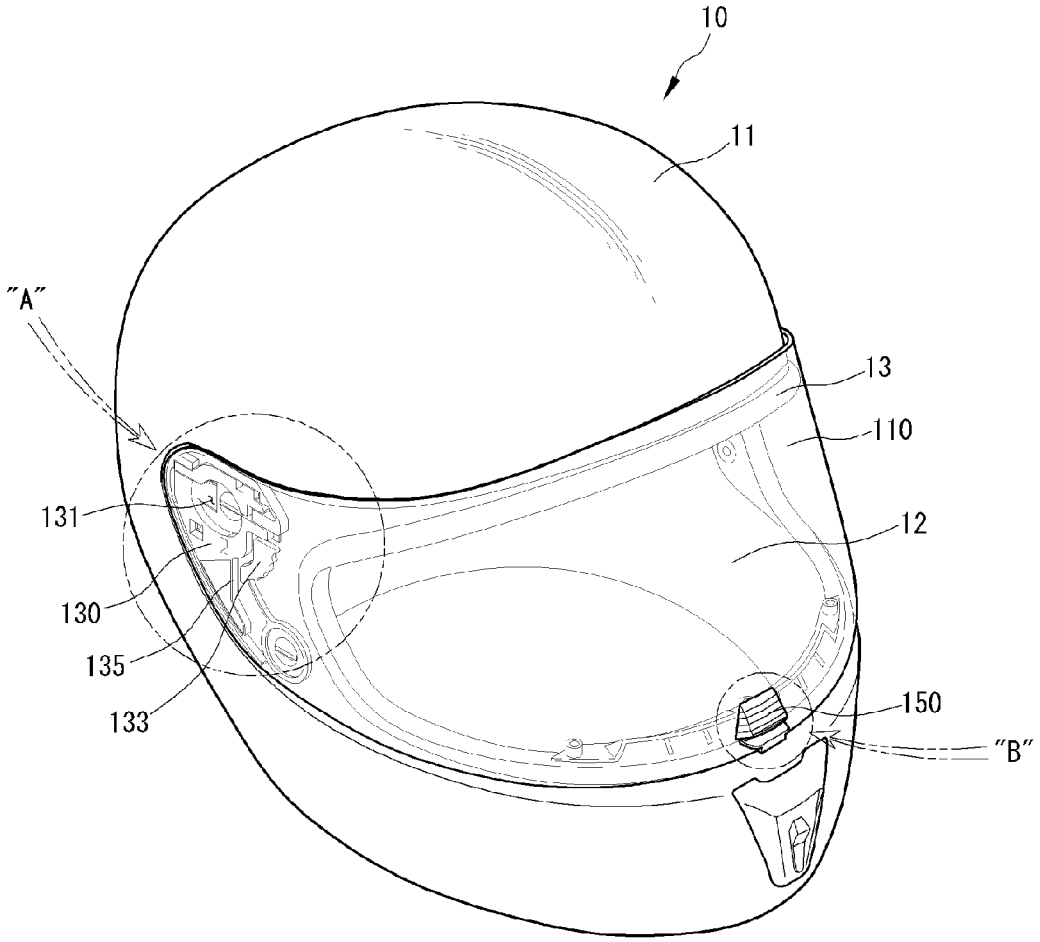
FIG. 1 is a perspective view of a helmet, in which a shield is at a closed position, in accordance with an embodiment of the present disclosure.

Hereinafter, embodiments of the present disclosure will be described in detail with reference to the accompanying drawings so that the present disclosure may be readily implemented by those skilled in the art. However, it is to be noted that the present disclosure is not limited to the embodiments but can be embodied in various other ways. In drawings, parts irrelevant to the description are omitted for the simplicity of explanation, and like reference numerals denote like parts through the whole document.

Through the whole document, the term "comprises or includes" and/or "comprising or including" used in the document means that one or more other components, steps, operation and/or existence or addition of elements are not excluded in addition to the described components, steps, operation and/or elements unless context dictates otherwise.

Hereinafter, there will be explained a helmet in accordance embodiments of the present disclosure by reference to FIGS. 1 to 10.

Figure 2:
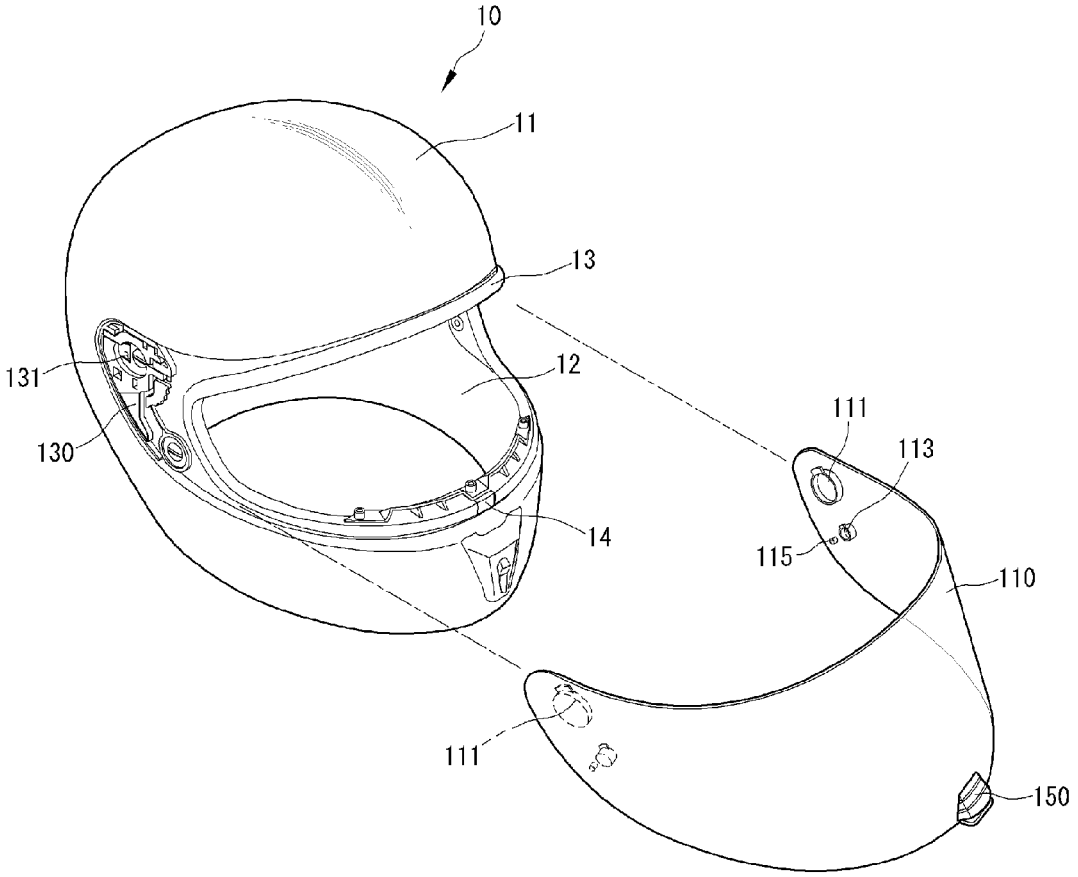
FIG. 2 is a perspective view of a helmet, in which a shield is unfastened from the helmet, in accordance with an embodiment of the present disclosure.

FIGS. 1 and 2 are perspective views of a helmet in accordance embodiments of the present disclosure. FIG. 1 shows a helmet in which a shield 110 is coupled to a helmet main body 11 and FIG. 2 shows a helmet in which a shield 110 is decoupled from a helmet main body 11.

Referring to FIGS. 1 and 2, a helmet 10 in accordance with an embodiment of the present disclosure may include a helmet main body 11, a front opening 12, a packing 13, a lock supporting member 14, a shield 110, a shield coupling assembly 130, and a locker 150.

The helmet 10 may be worn to protect a driver or a rider of a motorcycle or a race car from an accident while riding such a vehicle and the helmet 10 may include the helmet main body 11 which the driver wears and the front opening 12 allowing the driver to obtain a front view.

The helmet main body 11 may constitute a main body of the helmet 10, and its inner space where a helmet wearer's head is accommodated may be made of an elastic material such as urethane and the inner space may be made to fitly enclose the wearer's head. The helmet main body 11 may be made of various materials and designed in various ways for the sake of beautiful outward appearance and protection of a wearer's head. Further, the helmet main body 11 may include the front opening 12 at its front side to allow the wearer to obtain a front view.

The front opening 12 may be an opening provided at the front side of the helmet main body 11. The front opening 12 may enable the wearer of the helmet 10 to obtain a front view. The packing 13 may be provided along a rim of the front opening 12.

The packing 13 may be provided with a predetermined thickness along the rim of the front opening 12 and can be made of various materials such as rubber, urethane, and the like. The packing 13 may prevent the shield 110 from colliding with the helmet main body 11 when shield 110 moves to a closed position to be described later and may enable the helmet main body 110 to be hermetically sealed. The packing 13 may be provided along the rim of the front opening 12 with the lock supporting member 14 provided therebetween.

The lock supporting member 14 may be fixed to the helmet main body 11 so as to be provided at a front lower end of the front opening 12 and can be made of metal or plastic differently from the packing 13. The lock supporting member 14 may have a configuration in which a locker hooking part 154 to be described later is hooked by the lock supporting member 14 when the shield 110 is at the closed position for coupling of the shield 110 with the locker 150. Further, the lock supporting member 14 may have a configuration in which the locker hooking part 154 is readily unhooked from the lock supporting member 14 when the shield 110 is decoupled. If the above-described coupling and uncoupling can be carried out, a position, a shape and a configuration of the lock supporting member 14 can be changed in various ways.

An area indicated by an arrow A in FIG. 1 is the shield coupling assembly 130 and an area indicated by an arrow B is the locker 150. Details thereof will be provided below by reference to FIGS. 4 and 5.

Hereinafter, there will be explained the shield 110 capable of selectively opening or closing the front opening 12 by reference to FIG. 3.

Figure 3:
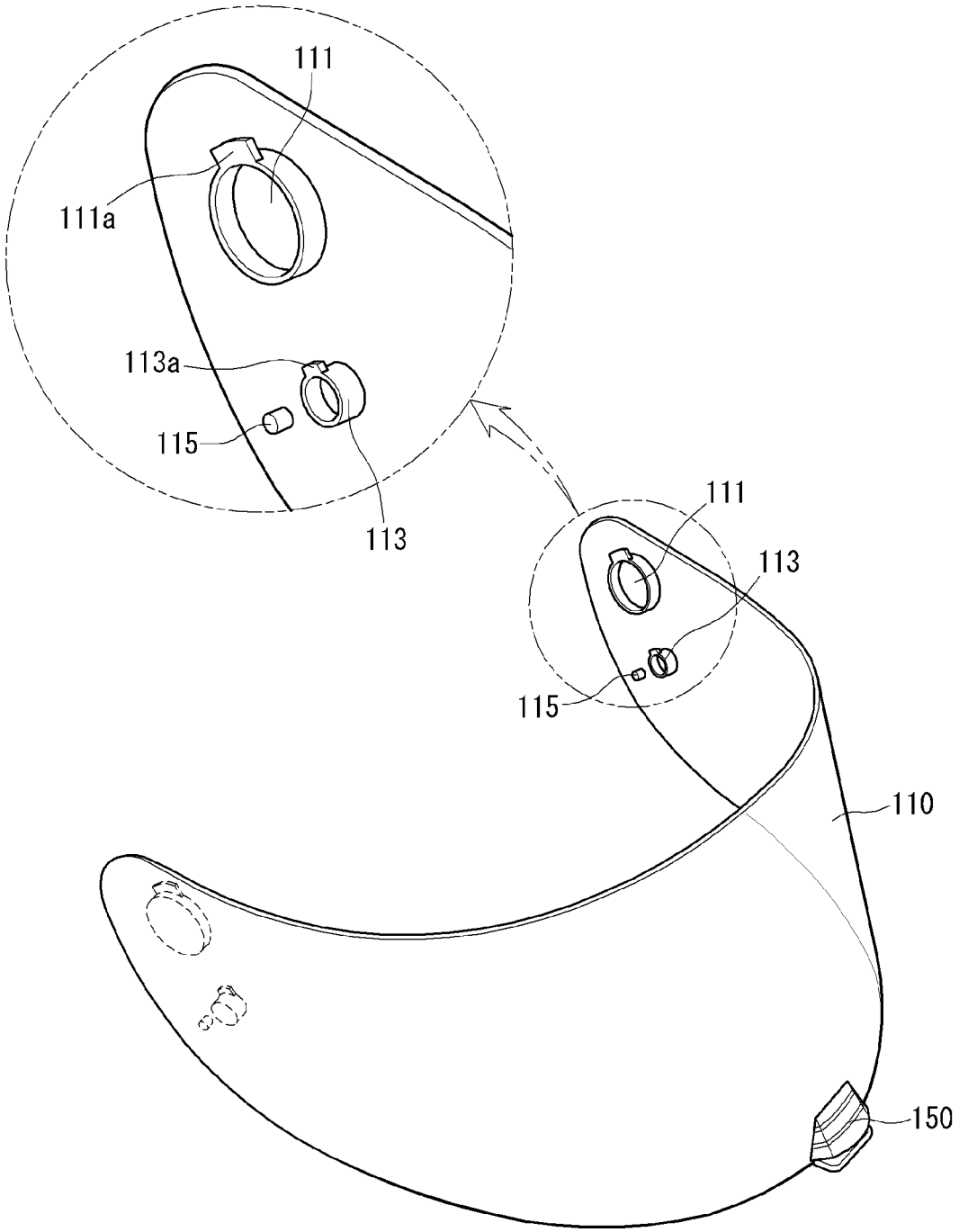
FIG. 3 is a perspective view of a shield in accordance with an embodiment of the present disclosure.

FIG. 3 is a perspective view of the shield 110 in accordance with the embodiment of the present disclosure.

The shield 110 may be a transparent window capable of selectively opening or closing the front opening 12 in order to prevent a helmet wearer's view from being blocked by wind, rain or snow coming from a front side while moving forwards. The shield 110 may include an inner coupling hole 111 and may further include a coupling rib 111*a*, a shield opening/closing adjusting hole 113, a adjusting hole rib 113*a*, and an elasticity supplying unit.

The inner coupling hole 111 may be provided at both side ends and protruded inwards for selectively opening or closing the front opening 12. The inner coupling hole 111 may be made of the same material as the shield 110 to be configured as one unit or may be configured as an additional component provided to the shield 110.

For the sake of more stable coupling and operation, the inner coupling hole 111 may further include the coupling rib 111*a* protruded from an end thereof.

The inner coupling hole 111 may be fitted and coupled to an assembly coupling hole 131, which will be explained below, of the shield coupling assembly 130. The coupling rib 111*a* can move along a coupling rib guiding space 132 to be described later.

The shield opening/closing adjusting hole 113 may be provided at both inner sides of the shield 110 and protruded inwards. The shield opening/closing adjusting hole 113 may be made of the same material as the shield 110 to be configured as one unit or may be configured as an additional component provided to the shield 110. The shield opening/closing adjusting hole 113 may enable a step-by-step adjustment of a opening degree of the shield 110 and may support the shield 110 so as to maintain its opened position selected by the wearer.

For the sake of more stable coupling and operation, the shield opening/closing adjusting hole 113 may further include the adjusting hole rib 113*a* protruded from an end thereof.

The shield opening/closing adjusting hole 113 may be engaged with a shield opening/closing adjusting protrusion 133, which will be explained below, of the shield coupling assembly 130 and the adjusting hole rib 113*a* can move along an adjusting rib guiding space 134. As the shield opening/closing adjusting hole 113 is engaged with the shield opening/closing adjusting protrusion 133 to be rotated up and down, the opening degree of the shield 110 can be adjusted and an opened position of the shield 110 can be maintained.

The elasticity supplying unit may be supplied with elasticity from an elastic unit or an elasticity applying body 135 of the shield coupling assembly 130 to be described later when the shield 110 is at the closed position. The elasticity supplying unit may be employed as a shield elasticity supplying part 115 in the present disclosure.

The shield 110 may include the shield elasticity supplying part 115, and the shield coupling assembly 130 to be de described later may elastically support the shield elasticity supplying part 115 in a direction to an opened position of the shield 110 when the shield 110 is at the closed position.

The shield elasticity supplying part 115 may be provided at both inner sides of the shield 110 and protruded inwards. The shield elasticity supplying part 115 may be made of the same material as the shield 110 to be configured as one unit or may be configured as an additional component provided to the shield 110. The shield elasticity supplying part 115 may be configured to be in pressurized contact with the elastic unit or the elasticity applying body 135 of the shield coupling assembly 130 to be described later when the shield 110 is at the closed position where the shield 110 is closed with the locker 150. The elasticity applying body 135 in pressurized contact with the shield elasticity supplying part 115 may transmit a repulsive force through the shield elasticity supplying part 115. When the locker 150 unlocks the shield 110, the shield 110 may be slightly lifted upwards by the repulsive force so as to be opened. Further, if the shield elasticity supplying part 115 is in pressurized contact with the elasticity applying body 135 when the shield 110 is at the closed position and the repulsive force of the elasticity applying body 135 can be transmitted to the shield 110, a shape and a configuration of the elasticity applying body 135 are not limited to illustration in the drawings of the present disclosure and can be provided in various ways.

Hereinafter, there will be explained the shield coupling assembly 130 provided at both sides of the helmet main body 11 by reference to FIG. 4.

Figure 4:
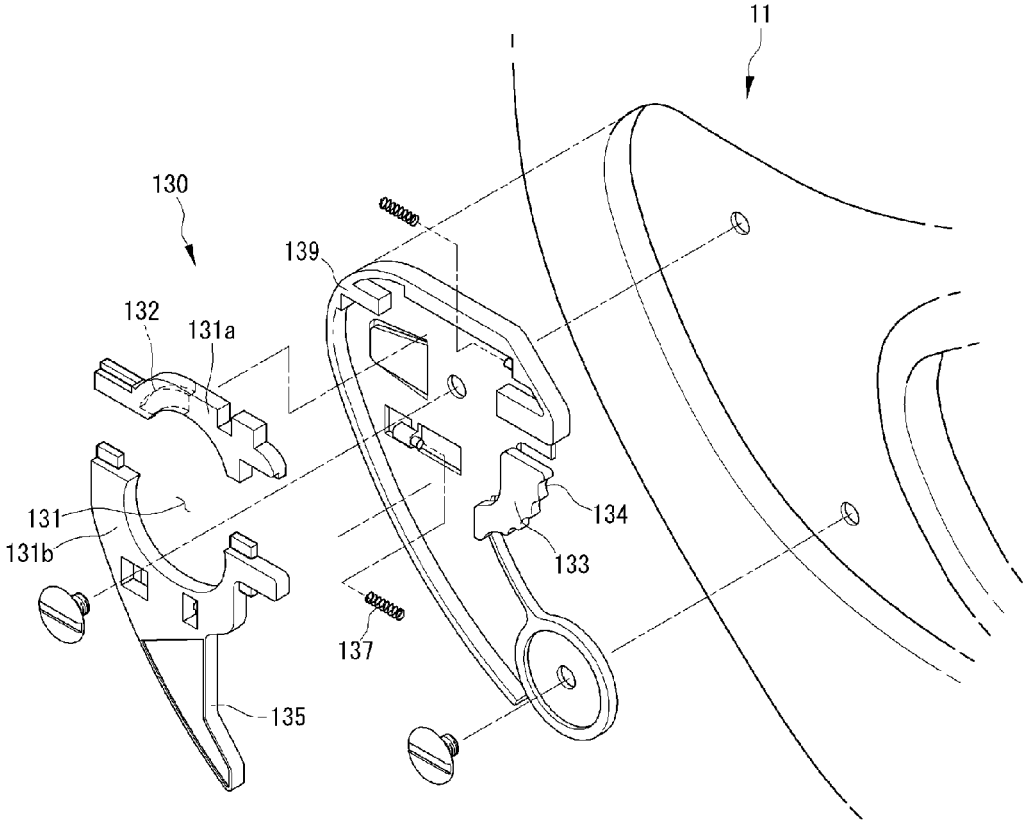
FIG. 4 is an exploded perspective view of a shield coupling assembly provided at both sides of a helmet main body.

FIG. 4 is an exploded perspective view of the shield coupling assembly 130 of the helmet 10 in accordance with the embodiment of the present disclosure.

The shield coupling assembly 130 may couple the shield 110 to both sides of the helmet main body 11 such that the shield 110 can be opened and closed up and down. The shield coupling assembly 130 may include a supporting plate 139 directly attached to the sides of the helmet main body 11, a rotation guiding unit attached to and supported by the supporting plate 139 so as to be fitted and coupled to the inner coupling hole 111 of the shield 110 and capable of supporting the shield 110 so as to be rotated up and down without being separated from the helmet main body 11, and an elastic unit capable of supplying predetermined elasticity to the shield 110 in a direction to the opened position of the shield 110 when the shield 110 is at the closed position. The rotation guiding unit may include the assembly coupling hole 131, the coupling rib guiding space 132, the shield opening/closing adjusting protrusion 133, and the adjusting rib guiding space 134. Further, the elastic unit may include the elasticity applying body 135 and an elastic body 137.

The assembly coupling hole 131 may be a cylindrical dented area provided at the shield coupling assembly 130 when a first assembly coupling member 131*a* and a second assembly coupling member 131*b* are coupled to the supporting plate 139. The assembly coupling hole 131 can be fitted and coupled to the cylindrical inner coupling hole 111 of the shield 110 and may have other shapes than the cylinder shape depending on a shape of the inner coupling hole 111 of the shield 110. Further, inside the first assembly coupling member 131*a*, there may be the coupling rib guiding space 132 that enables the coupling rib 111*a* to be rotated.

The coupling rib guiding space 132 may be formed between the first assembly coupling member 131*a* and the supporting plate 139 when a part of an inner lower surface of the first the first assembly coupling member 131*a* is opened and the first the first assembly coupling member 131*a* is coupled to the supporting plate 139. Since the coupling rib 111*a* provided at the inner coupling hole 111 can move along the coupling rib guiding space 132, the shield 110 can be selectively opened and closed up and down without being separated from the helmet main body 11.

When a part of a lower surface of the shield opening/closing adjusting protrusion 133 is supported by and attached to the supporting plate 139 and the supporting plate 139 is attached to the helmet main body 11, the shield opening/closing adjusting protrusion 133 may form the adjusting rib guiding space 134 thereunder. The shield opening/closing adjusting protrusion 133 may include one or more wave-shaped bent portions at an end engaged with the shield opening/closing adjusting hole 113. The shield opening/closing adjusting hole 113 engaged and moved with the shield opening/closing adjusting protrusion 133 according to an opened/closed position of the shield 110 may move along another bent portion of the protrusion 133. The wave-shaped bent portion may enable the shield opening/closing adjusting hole 113 to move readily. Since the shield opening/closing adjusting hole 113 is fitted and coupled the bent portion of the protrusion 133 when the shield 110 is at a selected position, it may be possible to prevent the shield 110 from unintendedly sliding down or being lifted upwards. Therefore, since the shield opening/closing adjusting hole 113 is configured to be engaged and rotated with the shield opening/closing adjusting protrusion 133 having multiple wave-shaped bent portions, the wearer can adjust an opened position of the shield 110 with ease and a selected opened position of the shield 110 can be maintained if additional manipulation is not made. Under the shield opening/closing adjusting protrusion 133, the adjusting rib guiding space 134 along which the adjusting hole rib 113*a* can be rotated may be further formed. The wave-shaped bent portion provided at an end of the shield opening/closing adjusting protrusion 133 is just an example shape which can be applied to the present disclosure. Various shapes which enable the shield opening/closing adjusting protrusion 133 to be fitted and coupled to the shield opening/closing adjusting hole 113 can be applied.

The adjusting rib guiding space 134 may be formed when only a part of the lower surface of the adjusting protrusion 133 is supported by and attached to the supporting plate 139. The adjusting hole rib 113*a* can be rotated along the adjusting rib guiding space 134 between the helmet main body 11 or the supporting plate 139 and the adjusting protrusion 133. If the shield opening/closing adjusting hole 113 is engaged and moved with the adjusting protrusion 133, the adjusting hole rib 113*a* may be engaged and moved with the shield opening/closing adjusting hole 113 along the adjusting rib guiding space 134. Thus, it may be possible to prevent the shield opening/closing adjusting hole 113 from being separated from the adjusting protrusion 133.

The elasticity applying body 135 may be elastically coupled to the supporting plate 139 through the elastic body 137 and may be in pressurized contact with the shield elasticity supplying part 115 when the shield 110 is at the closed position. While the shield 110 is opened, the elasticity applying body 135 may not be in contact with the shield elasticity supplying part 115, and an elastic repulsive force may not be generated. While the shield 110 is at the closed position where the shield fully covers the front opening 12 to hermetically seal the helmet main body 11, the elasticity applying body 135 may be applied with a force so as to be pushed to the opposite direction of the front opening 12 by the shield elasticity supplying part 115 in contact with the elasticity applying body 135. The elasticity applying body 135 applied with the force by the shield elasticity supplying part 115 can compress the elastic body 137 using the supporting plate fixed to the helmet main body 11 as a support. When the shield at the closed position is opened, the shield elasticity supplying part 115 pushing the elasticity applying body 135 to the opposite direction of the front opening 12 cannot push the elasticity applying body 135 any longer. On the contrary, the elasticity applying body 135 may be applied with an elastic force by which the elastic body 137 returns to its original state and may push the shield elasticity supplying part 115 to a direction of the front opening 12, i.e. to a direction of opening the shield 110. Based on this principle, the helmet wearer can readily open the shield 110. The elasticity applying body 135 shown in FIG. 4 is just an example for explaining an embodiment of the present disclosure and may be configured as one unit with the second assembly coupling member 131*b* or may be configured as a separate component. The elasticity applying body 135 may have various cross sections and configurations.

The elastic body 37 may be configured to elastically couple the elasticity applying body 135 to the supporting plate 139. The elastic body 137 may store a force applied from the shield elasticity supplying part 115 and the elasticity applying body 135 in sequence. The elastic body 137 may transmit the force to the elasticity applying body 135 the instant that the shield 110 at the closed position is opened and the force applied by the shield elasticity supplying part 115 disappears. The elastic body 137 may be any one of various elastic bodies, such as a spring, capable of elastically coupling the elasticity applying body 135 to the supporting plate 139.

The supporting plate 139 may be coupled to the first and second assembly coupling members 131*a* and 131*b*, the shield opening/closing adjusting protrusion 133, the elasticity applying body 135, and the elastic body 137, and the shield coupling assembly 130 including these components may be finally fixed to the helmet main body 11. The supporting plate 139 may be fixed to the helmet main body 11 with one or more screws and may have various shapes and configurations depending on shapes of the first and second assembly coupling members 131*a* and 131*b* coupled thereto.

Hereinafter, there will be explained the locker 150 capable of coupling the shield 110 to the lock supporting member 14 so as to be fastened or unfastened by reference to FIG. 5.

Figure 5:
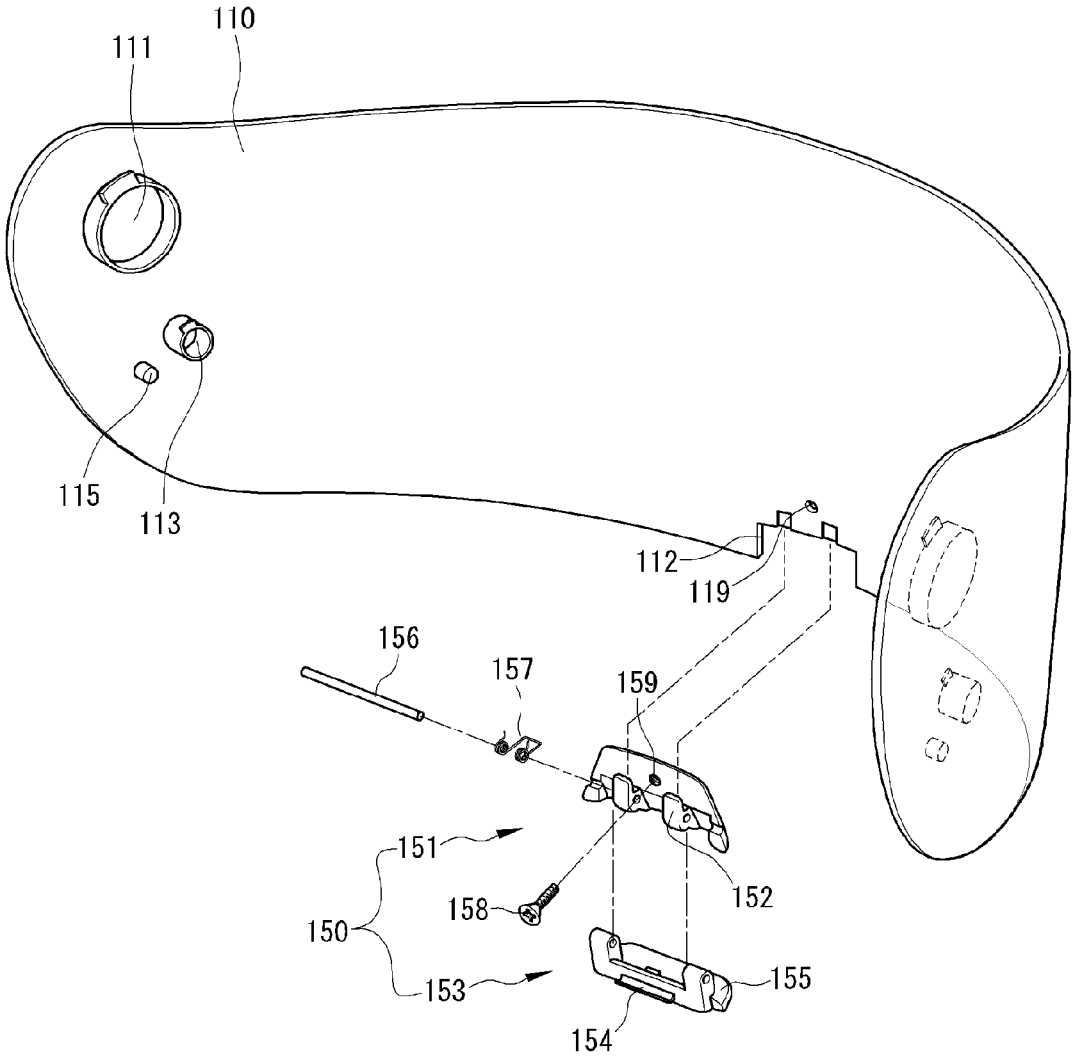
FIG. 5 is an exploded perspective view of a locker capable of making a shield be fastened or unfastened.

FIG. 5 is an exploded perspective view of the locker 150 in accordance with an embodiment of the present disclosure.

The locker 150 may couple the shield 110 to the lock supporting member 14 fixed to an end of the helmet main body 11 such that the shield 110 can be fastened or unfastened. The locker 150 may include a shield mounting portion 151 fixed to the shield 110, a coupling shaft coupled to be rotated with the shield mounting portion 151 at an end of the locker 150, and a locker hooking part 154, which will be explained below, coupled to or decoupled from the lock supporting member 14 at the other end of the locker 150. Further, the locker 150 may further include a touch unit 153 having a handle 155 protruded outwards from the shield 110 for convenience of the wearer.

The shield mounting portion 151 may be provided to fix the locker 150 to an end of the shield 110 and prevent the locker 150 from being unintendedly separated from the shield 110. Further, as depicted in FIG. 5, the shield mounting portion 151 may further include a mounting plate 152 at a rear surface thereof to be stably coupled to the shield 110. If the mounting plate 152 provided at the shield mounting portion 151 can be stably coupled to the shield 110, it may be provided to be protruded from or inserted into a surface of the shield mounting portion 151 other than the rear surface of the shield mounting portion 151.

The mounting plate 152 may be provided to be protruded from or inserted into the shield mounting portion 151 and may be configured to easily fix the shield mounting portion 151 to the shield 110. The end of the shield 110 may be inserted into an empty space formed between the mounting plate 152 and the rear surface of the shield mounting portion 151 to finally prevent the locker 150 from being unintendedly separated from the shield 110. Further, the mounting plate 152 may include a hole hollowed in a longitudinal direction at the protruded area such that the mounting plate 152 can be coupled via a locker shaft 156 so as to be rotated with the touch unit 153. It is just an example of the present disclosure and the mounting plate 152 may include components having various shapes and configurations which allow the mounting plate 152 to be rotated with the locker shaft 156 other than the hole hollowed in the longitudinal direction.

The touch unit 153 may couple or decouple the locker 150 to or from the lock supporting member 14. When the shield 110 is at the closed position, the locker 150 may be coupled to the lock supporting member 14 such that the shield 110 can keep the front opening 12 closed. When the shield 110 is not at the closed position, the locker 150 may be decoupled from the lock supporting member 14 such that the shield 110 may open the front opening 12. The touch unit 153 may include the locker hooking part 154 coupled to the lock supporting member 14 around the coupling shaft coupled to be rotated with the shield mounting portion 151 and the handle 155 protruded outwards from the shield 110.

Figure 6:
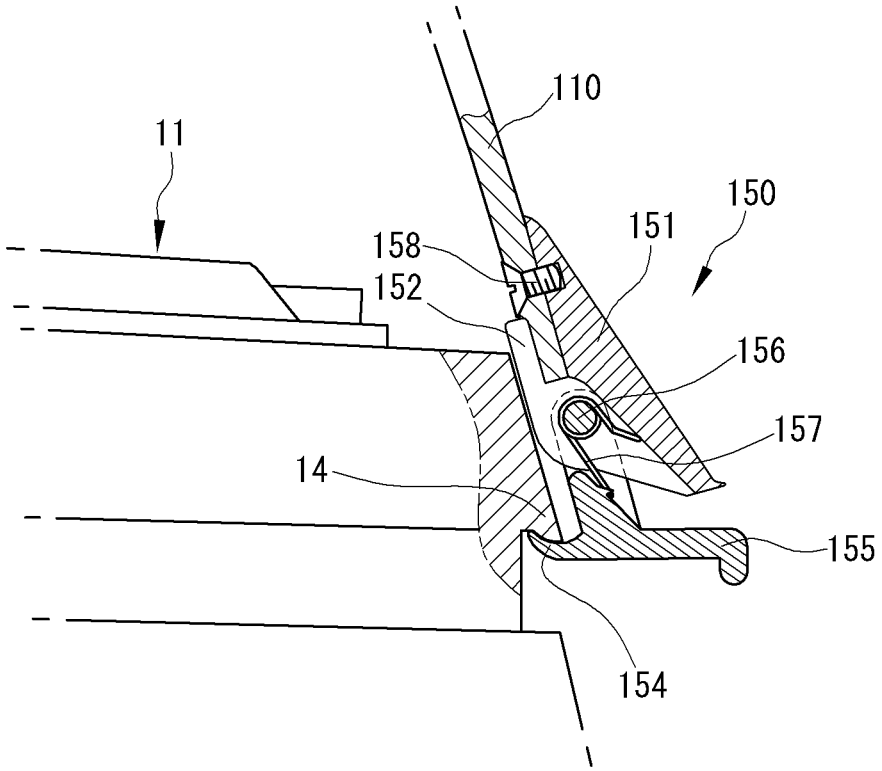
FIG. 6 is a cross sectional view showing that a locker is coupled to a lock supporting member when a shield is at a closed position.
Figure 8:
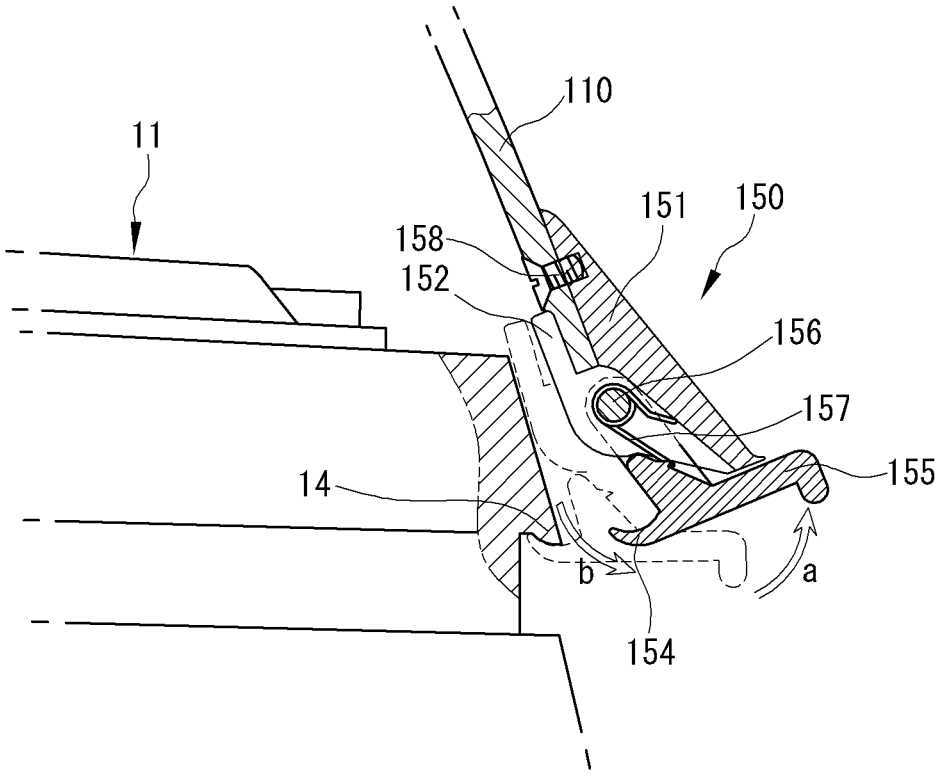
FIG. 8 is a cross sectional view showing that a locker is decoupled from a lock supporting member the instant that a shield at a closed position is opened.

The locker hooking part 154 may be formed at the touch unit 153 in a hook shape protruded to the inside of the shield 110. Through the locker hooking part 154, the touch unit 153 may be coupled to or decoupled from the lock supporting member 14. The lock supporting member 14 coupled to or decoupled from the locker hooking part 154 may have a shape in which a front side has a convex cross section and a rear side has a concave cross section in order for the locker hooking part 154 to be easily coupled or decoupled as depicted in FIG. 6 or 8. The locker hooking part 154 and the lock supporting member 14 may use any components or materials having various cross section shapes other than the hook shape if they can be coupled or decoupled each other to be allowed to make the shield 110 be fastened or unfastened.

The handle 155 may be protruded outwards from the shield 110 at the touch unit 153. The helmet wearer may rotate the shield 110 up and down by pulling or pushing the handle 155 with his/her fingers. The handle 155 may be protruded in the opposite direction of the locker hooking part 154 around the coupling shaft coupled to the shield mounting portion 151 to be rotated, and, thus, the locker hooking part 154 may face the opposite direction of a direction in which the handle 155 is pushed. In other words, if the helmet wearer pushes the handle 155 upwards (to a direction indicated by an arrow a in FIG. 8) when the shield 110 is coupled to the lock supporting member 14 by the locker 150, the locker hooking part 154 may face downwards (to a direction indicated by an arrow b in FIG. 8). Thus, the locker 150 may be decoupled from the lock supporting member 14. In this way, the front opening 12 closed by the shield 110 can be opened.

An end of the coupling shaft of the touch unit 153 may be coupled to the shield mounting portion 151 to be rotated and the other end thereof may include the locker hooking part 154 and the handle 155. The end of the coupling shaft of the touch unit 153 may include a hollow hole so as to be coupled to the shield mounting portion 151 to be rotated. The locker shaft 156 to be described later may penetrate through the hole hollowed in a longitudinal direction to be coupled thereto.

The locker shaft 156 may be long in a longitudinal direction such that the shield mounting portion 151 and the touch unit 153 can be coupled to each other so as to be rotated. The locker shaft 156 may penetrate each hole hollowed in the longitudinal direction at the end of the coupling shaft of the mounting plate 152 and the touch unit 153 so as to couple the shield mounting portion 151 to the touch unit 153. FIG. 5 shows one of examples, and the locker shaft 156 may be configured to directly couple an end of the shield mounting portion 151 to an end of the touch unit 153 or in other various ways. Further, the mounting plate 152 of the shield mounting portion 151 and an end of the touch unit 153 coupled by the locker shaft 156 may be elastically coupled to each other through an elastic member provided therebetween.

If the locker hooking part 154 is coupled to the lock supporting member 14, the elastic member may supply predetermined elasticity such that the locker hooking part 154 fitted and coupled to the lock supporting member 14 is kept coupled thereto. Further, if the locker hooking part 154 is decoupled from the lock supporting member 14, the elastic member may return the locker 150 to its original state. The elastic member may be provided in the form of a torsion spring 157 as depicted in FIG. 5.

The torsion spring 157 may be an elastic member may be coupled through the locker shaft 156 between the mounting plate 152 and the touch unit 153 coupled to each other so as to be rotated. The torsion spring 157 may supply elasticity between the mounting plate 152 and the touch unit 153 in contact therewith. To be more specific, if the handle 155 is pushed upwards, the touch unit 153 coupled to the mounting plate 152 and the locker shaft 156 so as to be rotated may be rotated counterclockwise (in a direction indicated by an arrow b in FIG. 8) and the torsion spring 157 may be compressed accordingly. Then, a force applied to the handle 155 is removed, the compressed torsion spring 157 may be returned to its original state while pushing the touch unit 153 to be returned to its original position. The torsion spring 157 depicted in FIG. 5 is one of examples for explaining an embodiment of the present disclosure and may include components having various shapes and configurations capable of supplying elasticity between the shield mounting portion 151 and the touch unit 153 coupled to each other so as to be rotated.

An additional coupling member can be provided such that the locker 150 can be more hermetically and stably coupled to the shield 110. As depicted in FIG. 5, an end of the shield 110 may include a guiding groove 112 which allows the shield mounting portion 151 to be effectively fixed to the shield 110.

The guiding groove 112 may be provided at the end of the shield 110 and may be formed corresponding to the shield mounting portion 151 and the mounting plate 152 such that the shield mounting portion 151 can be easily inserted into the shield and fixed thereto. Further, the guiding groove 112 can be provided at the end of the shield 110 in various shaped depending on the shapes of the shield mounting portion 151 and the mounting plate 152. In addition to the guiding groove 112, the shield mounting portion 151 may be screw-coupled to the shield 110.

The shield mounting portion 151 of the locker 150 may be screw-coupled to the shield 110 to be more hermetically and stably coupled thereto. A screw groove 159 may be provided at a rear surface of the shield mounting portion 151 and a screw hole 119 through which a screw penetrates may be provided at the shield 110 to be in contact with and in corresponding to the screw groove 159 of the shield mounting portion 151. As depicted in FIG. 5, a screw 158 may be inserted from the inside of the shield 110 through the screw hole 119 provided at the shield 110 and the inserted screw 158 may be coupled to the screw groove 159 of the shield mounting portion 151, so that the shield mounting portion 151 may be fixed to the shield 110. This is just an example of the present disclosure and the locker 150 may be configured in various ways capable of fixing the shield 110 without using a screw and a screw hole.

Hereinafter, there will be explained configurations of the shield coupling assembly 130 and the locker 150 when the shield 110 is at the closed position by reference to FIGS. 6 and 7.

FIG. 6 is a cross sectional view showing that the locker 150 is coupled to the lock supporting member 14 when the shield is at the closed position.

Figure 7:
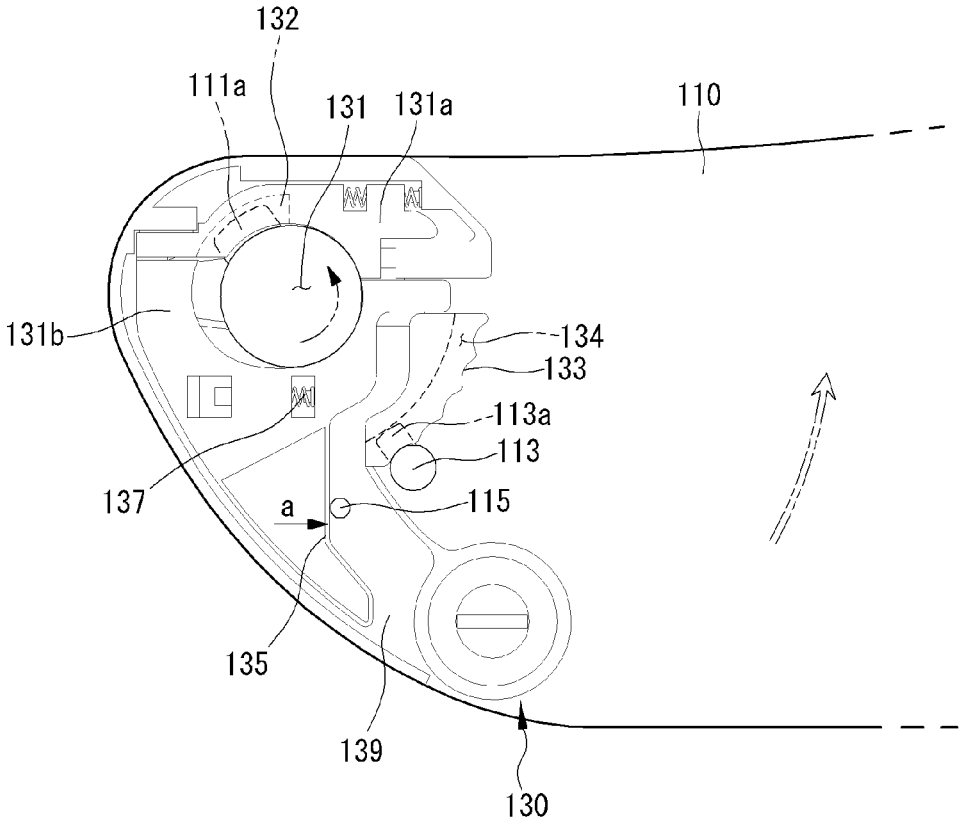
FIG. 7 is a side view of a shield coupling assembly when a shield is at a closed position.

FIG. 7 is a side view of the shield coupling assembly 130 when shield is at the closed position.

The closed position of the shield 110 may include a state where the shield 110 fully closes the front opening 12, i.e. where the touch unit 153 of the locker 150 is in a locked state while being coupled to the lock supporting member 14.

As depicted in FIG. 6, when the shield is at the closed position, the shield 110 may be inserted between the shield mounting portion 151 of the locker 150 and the mounting plate 152 and may be further fixed by the screw 158. The touch unit 153 elastically coupled to the shield mounting portion 151 by the locker shaft 156 and the torsion spring 157 to be rotatable may include the handle 155 protruded outwards from the shield 110 and the locker hooking part 154 may be provided inside the shield 110. The locker hooking part 154 may be coupled to the v fixed to the helmet main body 11. In this case, the lock supporting member 14 may have a shape in which a front side has a convex cross section and a rear side has a concave cross section in order for the locker hooking part 154 to be easily coupled or decoupled.

As depicted in FIG. 7, when the shield 110 is at the closed position, the inner coupling hole 111 of the shield 110 may be fitted and coupled to the assembly coupling hole 131 of the shield coupling assembly 130 and the coupling rib 111*a* may be positioned in the coupling rib guiding space 132 provided below the first assembly coupling member 131*a*. Further, the shield opening/closing adjusting hole 113 may be engaged with a wave-shaped bent portion provided at a lowermost area of the shield opening/closing adjusting protrusion 133 and the adjusting hole rib 113*a* may be positioned in the adjusting rib guiding space 134. The elasticity supplying part 115 may be in pressurized contact with the elasticity applying body 135 by the elastic body supported by the supporting plate 139.

Hereinafter, there will be explained the configurations of the shield coupling assembly 130 and the locker 150 the instant that the shield 110 at the closed position is opened by reference to FIGS. 8 and 9.

FIG. 8 is a cross sectional view showing that the locker 150 is decoupled from the lock supporting member 14 the instant that the shield 110 at the closed position is opened.

Figure 9:
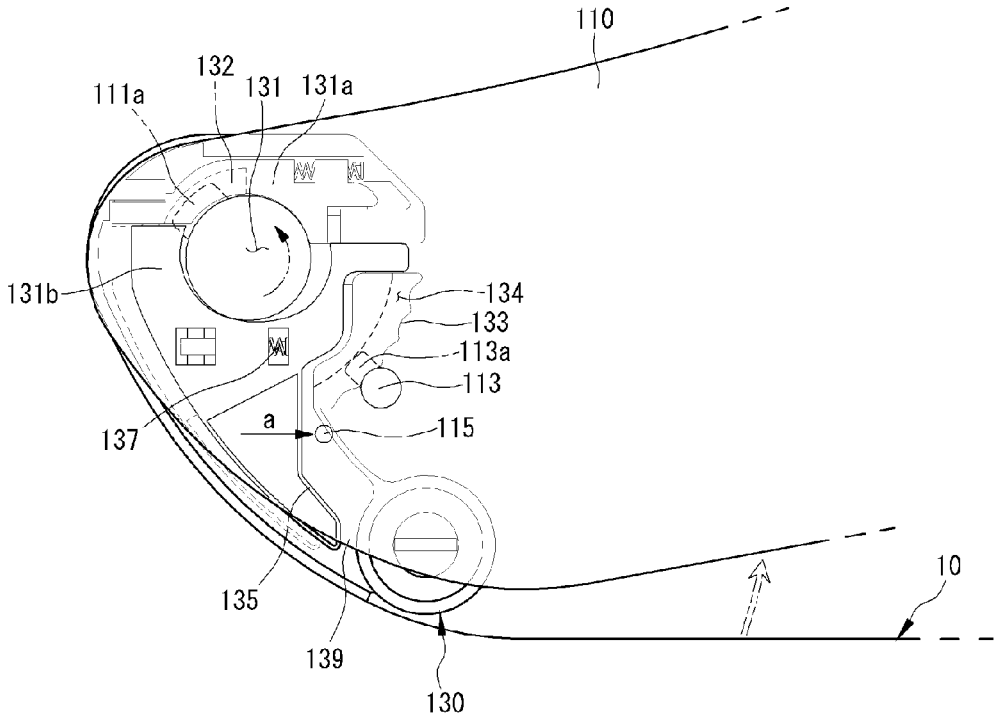
FIG. 9 is side view of a shield coupling assembly the instant that a shield at a closed position is opened.

FIG. 9 is side view of the shield coupling assembly 130 the instant that the shield 110 at the closed position is opened.

The instant that the shield 110 at the closed position is opened may include the instant that the locker hooking part 154 is decoupled from the lock supporting member 14 and the front opening 12 closed by the shield 110 is opened.

As depicted in FIG. 8, the instant that the shield 110 at the closed position is opened can be seen if the handle 155 of the touch unit 153 elastically coupled by the locker shaft 156 and the torsion spring 157 to be rotated is pushed upwards when the shield 110 is at the closed position. If the handle 155 is slightly pushed upwards in a direction indicated by an arrow a, the locker hooking part 154 provided in the opposite direction across the coupling shaft the touch unit 153 may be moved downwards while being rotated counterclockwise in a direction indicated by an arrow b. Thus, the locker hooking part 154 coupled to the lock supporting member 14 may be decoupled therefrom and shield 110 may be decoupled from the helmet main body 11 to open the front opening 12.

As depicted in FIG. 9, the elastic body 137 compressed by the supporting plate 138 as a support may apply elasticity for returning to its original state to the elasticity applying body 135 the instant that the shield 110 at the closed position is opened. The elasticity applying body 135 may transmit the elasticity applied by the elastic body 137 to the elasticity supplying part 115 (in a direction indicated by an arrow a), and the shield 110 may be slightly opened automatically by the elasticity transmitted to the shield 110 through the elasticity supplying part 115 the instant that the shield 110 at the closed position is opened. Based on this principle, it may be possible to provide the helmet 10 including the shield which can be opened by one-touch operation. The shield opening/closing adjusting hole 113 may be moved from the bent portion provided at the lowermost area of the shield opening/closing adjusting protrusion 133 to a wave-shaped bent portion provided at a second lowermost area so as to be engaged therewith. In this way, the shield 110 may be automatically kept in a slightly opened state if additional manipulation is not made by the helmet wearer.

Hereinafter, there will be explained a configuration of the shield coupling assembly 130 when the shield 110 is at a fully opened position by reference to FIG. 10.

Figure 10:
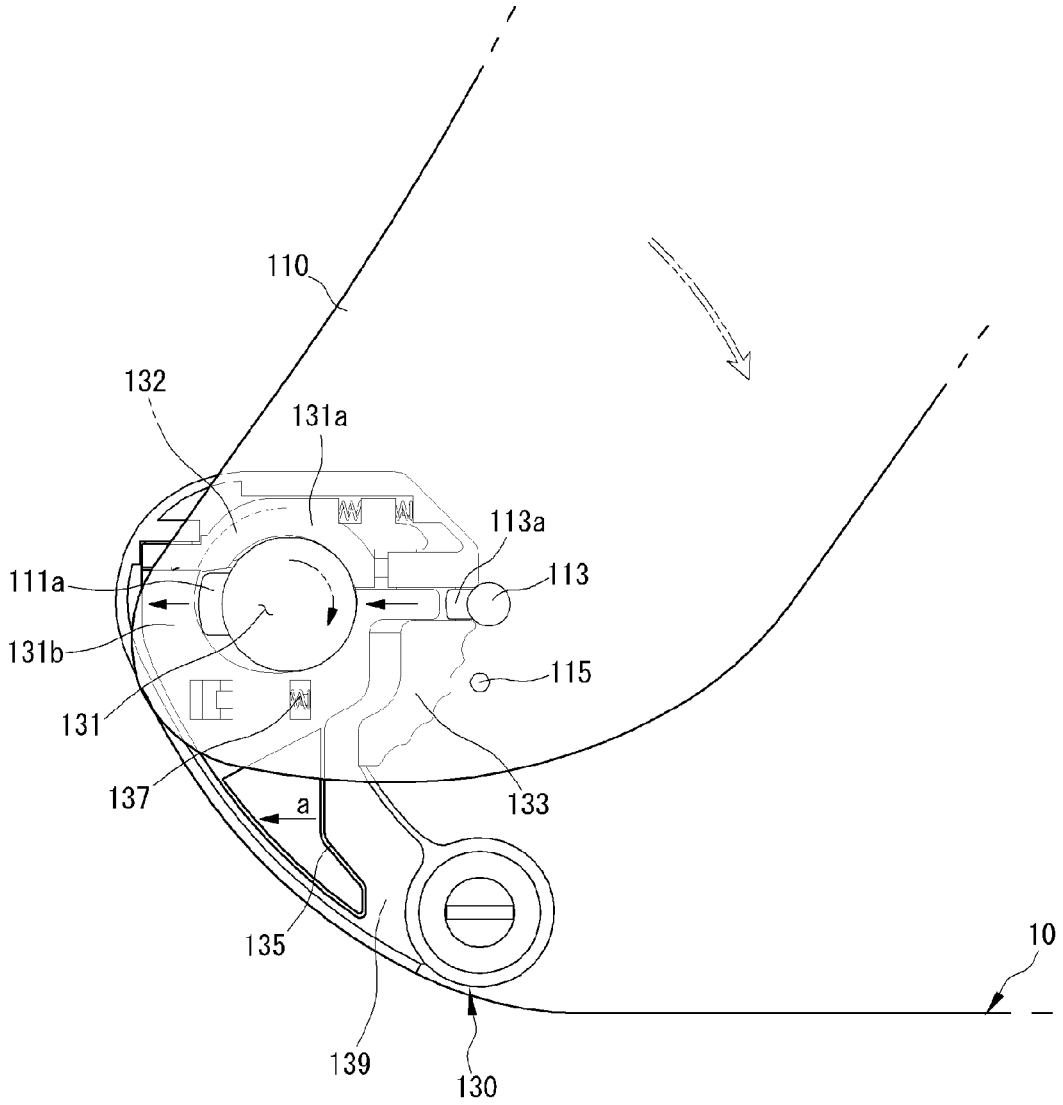
FIG. 10 is a side view of a shield coupling assembly when a shield is at a fully opened position.

FIG. 10 is a side view of the shield coupling assembly 130 when the shield 110 is at a fully opened position.

The fully opened position may include a state where the shield 110 fully opens the front opening 12, i.e. where the shield 110 is raised upwards to the maximum while being fastened to the helmet main body 11.

As depicted in FIG. 10, when the shield 110 is at a fully opened position, the inner coupling hole 111 of the shield 110 may be fitted and coupled to the assembly coupling hole 131 of the shield coupling assembly 130, and the coupling rib 111*a* may come out of the coupling rib guiding space 132 provided below the first assembly coupling member 131*a* and may be hooked by the second assembly coupling member 131*b*. A part of an inner lower surface of the second assembly coupling member 131*b* may be opened and when the second assembly coupling member 131*b* is coupled to the supporting plate 139, an empty space capable of accommodating the coupling rib 111*a* may be provided thereunder. Further, the shield opening/closing adjusting hole 113 may come out of a wave-shaped bent portion provided at an uppermost area of the shield opening/closing adjusting protrusion 133 and the adjusting hole rib 113*a* may be hooked by the second assembly coupling member 131*b*. A part of an inner lower surface of the second assembly coupling member 131*b* may be opened and when the second assembly coupling member 131*b* is coupled to the supporting plate 139, an empty space capable of accommodating the adjusting hole rib 113*a* may be provided thereunder. The elasticity applying body 135 may be exposed to the outside as much as possible when the shield 110 is at a fully opened position. If the elasticity applying body 135 is pushed in a direction indicated by an arrow a in FIG. 10 (in the opposite direction of the front opening 12), the second assembly coupling member 131*b* configured as one unit with the elasticity applying body 135 may also be pushed in the direction indicated by the arrow a. Thus, the coupling rib 111*a* and the adjusting hole rib 113*a* can be separated from the shield coupling assembly 130 and the shield 110 can be separated from the helmet main body 11. The second assembly coupling member 131*b* may be configured as a component separated from the elasticity applying body 135. In this case, the second assembly coupling member 131*b* may be configured to be applied with elasticity transmitted to the elasticity applying body 135 through the supporting plate 139.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure.

The scope of the present disclosure is defined by the following claims rather than by the detailed description of the embodiment. It shall be understood that all modifications and embodiments conceived from the meaning and scope of the claims and their equivalents are included in the scope of the present disclosure.

What is claimed is:

1. A helmet including a shield having inner coupling holes at both ends thereof and fitted and coupled to an assembly coupling hole of a shield coupling assembly provided at a helmet main body and a front opening configured to be opened and closed by the shield, the helmet comprising:

a lock supporting member fixed to the helmet main body; and a locker including a shield mounting portion fixed to the shield and a touch unit, wherein the touch unit includes a locker hooking part coupled to be rotated with the shield mounting portion around a coupling shaft and a handle protruded outwards from the shield, wherein the locker hooking part is coupled to or decoupled from the lock supporting member, wherein if the handle is pushed upwards, the locker hooking part moves downwards.

2. The helmet of claim 1, wherein the locker further includes an elastic member configured to supply predetermined elasticity to keep the locker hooking part fitted and coupled to the lock supporting member coupled thereto if the locker hooking part is coupled to the lock supporting member.

3. The helmet of claim 1, wherein the shield includes shield elasticity supplying parts protruded at both inner sides thereof, and the shield coupling assembly elastically supports the shield elasticity supplying parts in a direction to an opened position of the shield when the shield is at a closed position.

4. The helmet of claim 3, wherein the shield coupling assembly includes:

a supporting plate attached to both sides of the helmet main body;

a rotation guiding unit attached to and supported by the supporting plate to be fitted and coupled to the inner coupling holes of the shield and capable of supporting the shield to be rotated up and down without being separated from the helmet main body; and an elastic unit capable of supplying predetermined elasticity to the shield elasticity supplying parts in the direction to the opened position of the shield when the shield is at the closed position.

5. The helmet of claim 4, wherein the elastic unit includes:

an elasticity applying body elastically coupled to the supporting plate; and an elastic body provided between the elasticity applying body and the supporting plate, wherein when the shield at the closed position is opened, the elastic body applies the predetermined elasticity to the shield elasticity supplying parts in the direction to the opened position of the shield to partially open the shield.

6. A helmet including a shield having inner coupling holes at both ends thereof and fitted and coupled to an assembly coupling hole of a shield coupling assembly provided at a helmet main body and a front opening configured to be opened and closed by the shield, the helmet comprising:

a lock supporting member fixed to the helmet main body; and a locker fixed to the shield to be coupled to or decoupled from the lock supporting member, wherein when the shield is at a closed position, the locker is coupled to the lock supporting member and when the shield is at an opened position, the locker is decoupled from the lock supporting member, when the shield moves from the opened position to the closed position, the locker is hooked by the lock supporting member and automatically coupled thereto, wherein the locker includes a shield mounting portion fixed to the shield and a touch unit, wherein the touch unit includes a locker hooking part coupled to be rotated with the shield mounting portion around a coupling shaft and a handle protruded outwards from the shield, wherein if the handle is pushed upwards, the locker hooking part moves downwards.

7. The helmet of claim 6, wherein when the shield is at the closed position, the shield is elastically supported by the shield coupling assembly to have predetermined elasticity in a direction to the opened position thereof.

8. The helmet of claim 6, wherein when the shield at the closed position is opened, the elastically supported shield is partially opened in the direction to the opened position.

* * * * *